US008578627B2

(12) United States Patent
Kmet et al.

(10) Patent No.: US 8,578,627 B2
(45) Date of Patent: Nov. 12, 2013

(54) METHOD AND APPARATUS FOR MOISTURE SENSOR NOISE IMMUNITY

(75) Inventors: David J. Kmet, Paw Paw, MI (US); David M. Williams, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 442 days.

(21) Appl. No.: 12/909,192

(22) Filed: Oct. 21, 2010

(65) Prior Publication Data

US 2012/0096737 A1 Apr. 26, 2012

(51) Int. Cl.
*D06F 58/28* (2006.01)

(52) U.S. Cl.
USPC ..... 34/491; 34/443; 34/524

(58) Field of Classification Search
USPC ..... 34/443, 524, 552, 528
See application file for complete search history.

(56) References Cited

U.S. PATENT DOCUMENTS

| | | | | |
|---|---|---|---|---|
| 3,702,030 | A | 11/1972 | Janke | |
| 4,215,486 | A | 8/1980 | Heyer et al. | |
| 4,385,452 | A | 5/1983 | Deschaaf et al. | |
| 4,531,307 | A | 7/1985 | Kuecker | |
| 4,785,843 | A | 11/1988 | Nicholson | |
| 6,442,420 | B1 * | 8/2002 | Julu et al. | 600/509 |
| 6,446,357 | B2 * | 9/2002 | Woerdehoff et al. | 34/491 |
| 6,466,037 | B1 | 10/2002 | Meerpohl et al. | |
| 6,650,193 | B2 * | 11/2003 | Endo et al. | 331/78 |
| 7,345,491 | B2 | 3/2008 | Pezier | |
| 2006/0242859 | A1 | 11/2006 | Pezier | |

FOREIGN PATENT DOCUMENTS

| | | | |
|---|---|---|---|
| DE | 1935511 | A1 | 1/1971 |
| DE | 2930671 | A1 | 2/1981 |
| DE | 102008044324 | A1 | 6/2010 |
| EP | 0967319 | A1 | 12/1999 |
| EP | 1816253 | B1 | 8/2007 |
| FR | 1564923 | A | 4/1969 |
| WO | 2010/063554 | A1 | 6/2010 |

OTHER PUBLICATIONS

German Search Report for DE102011052847, Apr. 20, 2012.

* cited by examiner

*Primary Examiner* — Kenneth Rinehart
*Assistant Examiner* — Tiffany Johnson

(57) ABSTRACT

A method of controlling the operation of a clothes dryer with a moisture sensor having a conductivity circuit with spaced contacts.

16 Claims, 8 Drawing Sheets

METHOD AND APPARATUS FOR MOISTURE SENSOR NOISE IMMUNITY

BACKGROUND OF THE INVENTION

Clothes dryers may have the ability to detect the moisture of the laundry being dried. The corresponding moisture information may be used to determine time to the end of the drying cycle. The moisture of the laundry may be detected by a moisture sensor. A common moisture sensor found in dryers is a conductivity circuit having two conductive metal strips arranged to come in contact with laundry contained within the clothes dryer. When wet laundry of an appropriate conductivity makes contact with both conductive metal strips a shunt current may flow from one conductive strip to the other through the laundry. Moisture readings may be used to determine when laundry is sufficiently dry to determine the end of the drying cycle. Often times the moisture sensor output can be corrupted by various sources of noise, including 60 Hz line noise, circuit and relay switching noise, and electrostatic discharge.

SUMMARY OF THE INVENTION

A method controlling the operation of a clothes dryer comprising a drying chamber and a moisture sensor having a conductivity circuit with spaced contacts extending into the drying chamber. The moisture sensor provides an output signal related to the conductivity of laundry. The output signal is modulated to a frequency band different than the frequency band of the output signal to generate a modulated output signal. The modulated output signal is filtered within a predetermined frequency band to generate an output signal indicative of the laundry providing electrical conductivity across the spaced contacts.

DESCRIPTION OF AN EMBODIMENT OF THE INVENTION

The present invention relates generally to a clothes dryer having a moisture sensor with spaced contacts that detect laundry providing a conductive path across the spaced contact. More specifically, the invention is related to providing a more robust moisture sensor signal, by using modulation techniques to filter common sources of noise in the moisture sensor system.

Figure 1:
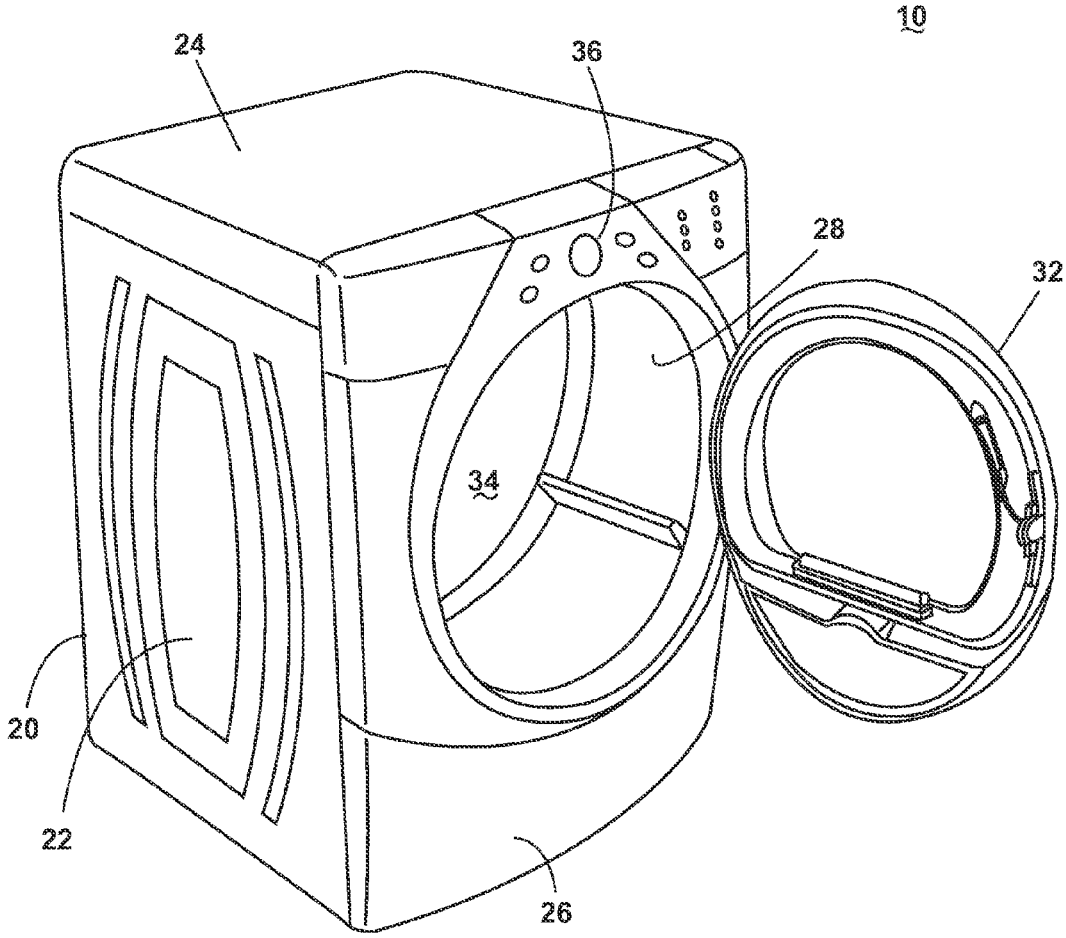
FIG. 1 is a perspective view of a clothes dryer according to an embodiment of the invention.

FIG. 1 is a perspective view of clothes dryer 10 with a cabinet that may be formed by panels mounted to a chassis. There is a rear panel 20, side panel 22, top panel 24, and front panel 26. There may be an opening within the front panel 26 where a door 32 selectively opens or closes. The door 32 may be opened to access a drying chamber 34, which is illustrated as being formed by a drum 28, located within the interior of the cabinet. The drum 28 may be rotatable to provide rotation for the drying chamber 34. A user interface 36 may be disposed on the front panel 26 of the clothes dryer 10. The user interface 36 may provide for a user to select or modify a predetermined cycle of operation of the clothes dryer.

While the invention is described in the context of a clothes dryer, it is applicable to other types of laundry treating devices where drying occurs. For example, "combo" machines, which perform both a clothes washing and a clothes drying function may incorporate the invention.

Figure 2:
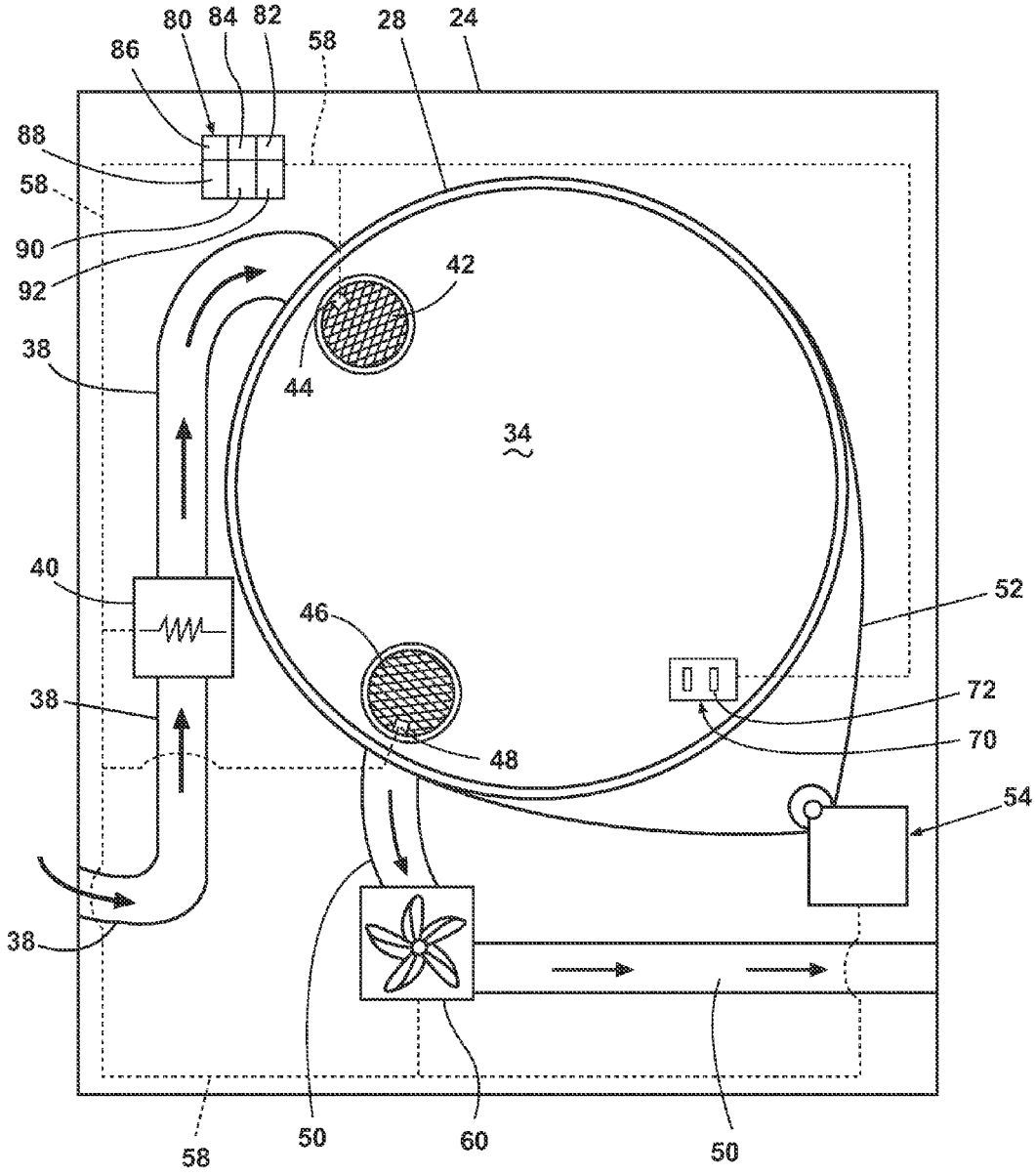
FIG. 2 is a schematic sectional view through the clothes dryer of FIG. 1 showing a drying chamber with a moisture sensor and a controller according to an embodiment of the invention.

FIG. 2 is a sectional view through the clothes dryer showing the drying chamber 34 defined by the drum 28 and illustrating the air flow system, sensors, and controls. The air flow system includes an air inlet 42 to the drying chamber 34, which is supplied air via an air inlet conduit 38, and an air outlet 46 to the drying chamber 34, which is exhausted air via an air outlet conduit 50. While the inlet 42 and outlet 46 are shown in the same wall or bulkhead for ease of illustration, in many cases they are on opposite walls or bulkheads.

A heating element 40 may be provided in the inlet conduit 38 to heat the air passing through the air flow system. A blower 60, fixed, multiple or variable speed, may be provided in the air outlet conduit 50 to draw air through the air flow system. The air entering the drying chamber 34 may be selectively heated by energizing or de-energizing the heating element 40. A motor 54 may be provided for rotating the drum 28 via drive belt 52. A direct drive motor may also be used.

An air inlet temperature sensor 44 may be located in fluid communication with the air flow system to detect the air inlet temperature. The air inlet temperature sensor 44 may be located anywhere along the inlet conduit 38 and is illustrated at the air inlet 42. An air outlet temperature sensor 48 may also be in fluid communication with the air flow system to detect the air outlet temperature. The air outlet temperature sensor 48 may be located anywhere along the air outlet conduit 50 and is illustrated at the air outlet 46. The inlet temperature sensor 42 and the outlet temperature sensor 48 may be thermistors or any other known temperature sensing device. A moisture sensor 70 for detecting the presence of moisture may be located within the drying chamber 34. The moisture sensor 70 may contain two spaced contacts 72 to detect wet laundry spanning the contacts 72, which is commonly referred to as wet hits. The two spaced contacts 72 are often also referred to as conductivity strips.

A controller 80 may be coupled via electrical communication lines 58 to the various electronic components of the clothes dryer 10 including the user interface panel 36, the heating element 40, the inlet temperature sensor 44, the outlet temperature sensor 48, the humidity sensor 70, the motor 54, and the blower 60. The controller 80 may be a microprocessor, microcontroller, field programmable gate array (FPGA), application specific integrated circuit (ASIC), or any other known circuit for control of electronic components. The controller 80 may contain an electronic memory 92 for storing information from the various electronic components. The controller 80 may also contain additional circuitry including an oscillator circuit 82, moisture sensor input circuit 84, comparator circuit 86, filter circuit 88, and logic circuits 90.

Under normal operation, the controller 80 may sample the output of the moisture sensor sequentially for a predefined time period and count the number of indications of moist laundry shorting the spaced contacts 72 as "wet hits". The wet hit counts and the corresponding duty cycle may then be used to determine the dryness of the clothes or to determine the time to finish drying the clothes. The wet hits counts and duty cycle are indicative of laundry providing electrical conductivity between across the spaced contacts 72, which in turn is related to the moistness of the laundry. In other words, when electrically conductive laundry come in contact with both of the spaced contacts 72, it provides a shunt electrical path across the two spaced contacts 72, which may be sampled as a wet hit with specific duty cycle by the controller 80. The specific operation of a suitable moisture sensor 70 is described in U.S. Pat. No. 6,446,357 to C. J. Woerdehoff, et al., and is hereby incorporated in its entirety by reference.

It should also be noted that the spaced contacts 72 are floating electrodes and as such may be highly susceptible to electromagnetic interference (EMI) and noise. In addition, there may be long wiring harnesses (not shown) attached to the spaced contacts 72 outside of the drum 28 that may act as an antenna and be prone to and propagate EMI. This EMI may include 60 Hz line noise, voltage and current induced signals, various switching noises, and electrostatic discharge (ESD) noise. These various sources of noise may interfere with the process of obtaining an accurate reading of the moisture sensor signal and accurately detecting wet hits. The invention provides a more robust method of detecting the moisture sensor 70 signal from the surrounding noise by applying modulation and filtering techniques upon the moisture sensor 70 signal.

Figure 3:
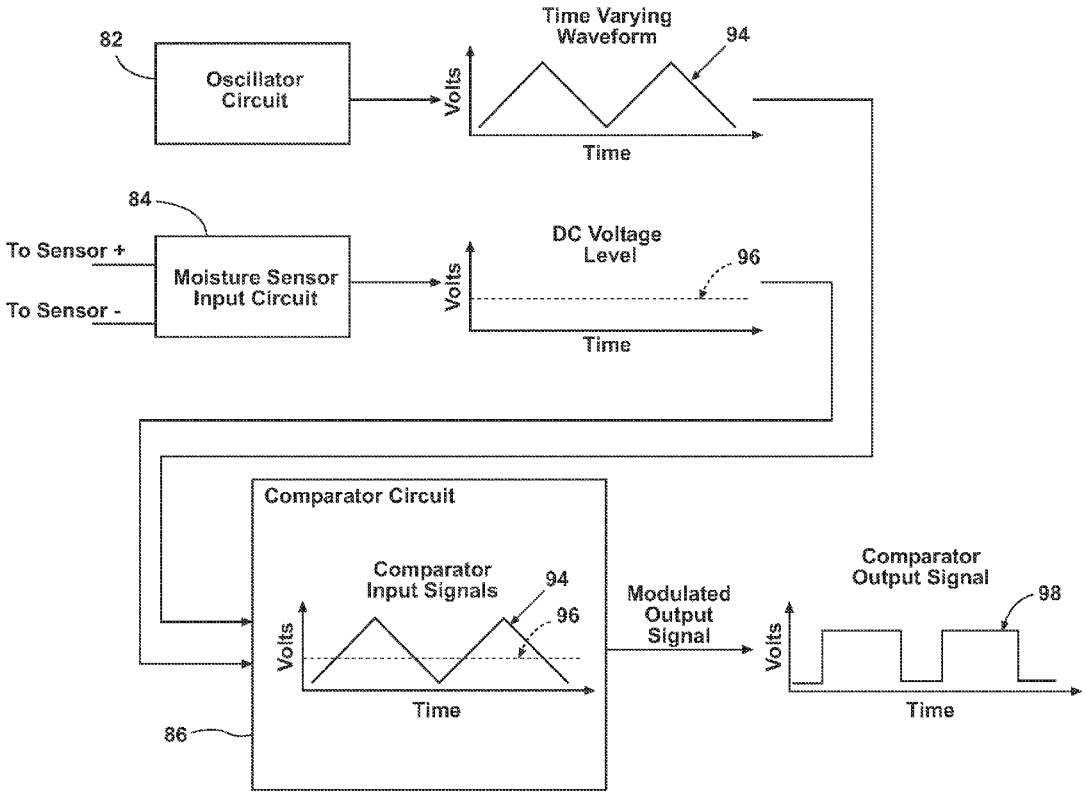
FIG. 3 is a block diagram depicting a modulator for the generation of a modulated output signal according to an embodiment of the invention.

FIG. 3 is a block diagram depicting a modulator for generation of a modulated output signal according to one embodiment of the present invention. The modulator comprises an oscillator circuit 82 for generating a reference signal, a moisture sensor input circuit 84 for accepting the output signal from the moisture sensor 70, and a comparator circuit 86 to compare the reference signal and the moisture sensor output signal to perform the modulation.

The oscillator circuit 82 may generate a reference signal 94, such as a time varying waveform, which is illustrated as a triangle wave with a predetermined oscillation frequency. For the anticipated noise conditions in the dryer environment, the oscillation frequency may be approximately 200 Hz.

The moisture sensor input circuit 84 has electrical inputs each of which are connected to the two spaced contacts 72 of the moisture sensor 70. The moisture sensor input circuit 84 has an input and output impedance that interacts with the conductivity of the clothes such that the voltage level 96 varies significantly across the periodic signal 94 to encode the conductivity sensed across at the input into the modulated output signal duty cycle. The output of the moisture sensor input circuit 84 is a voltage level 96 across the spaced contacts of the moisture sensor 70.

Both the output signal and the reference signal are input to the comparator circuit 86. The comparator circuit 86 compares the relative levels of the two input signals and when the reference signal is greater than the moisture sensor output signal, the comparator circuit 86 outputs a high output signal. Conversely, when the reference signal is less than the moisture sensor output signal the comparator circuit 86 outputs a low output signal. Therefore, the comparator circuit 86 generates a square wave with the same frequency as the reference signal, where the duty cycle of the square wave depends on the relative magnitudes of the reference signal and the moisture sensor output signal at any given point in time. In other words, the output signal is modulated by comparing the output signal of the moisture sensor 70 to the reference signal generated at the oscillator circuit 82 by the comparator circuit 86. The duty cycle of modulated output signal 98 may be indicative of the laundry providing electrical conductivity across the spaced contacts. The output signal of the comparator circuit 86 may be a pulse width modulated (PWM) output signal 98 of the moisture sensor 70 output that is representative of moisture content of the laundry.

The oscillator circuit 82 may be any known type of oscillator including, but not limited to a phase shift oscillator, crystal oscillator, multivibrator, ring oscillator, or Schmidt trigger oscillator. Although the oscillator circuit is shown to generate a triangle wave reference signal, the oscillator may generate any known type of signal, including, but not limited to a sinusoidal, truncated or rectified sinusoidal, trapezoidal, saw tooth, or square wave. In general the dynamic range of a modulated output signal may be greater with reference signals that have a low slew rate.

The moisture sensor input circuit 84 may have only passive components such as resistors, capacitors, and inductors. Alternatively, the moisture sensor input circuit 84 may also have active components such as operational amplifiers, diodes, or transistors. In some cases the moisture sensor input circuit 84 may inherently filter some noise from the moisture sensor output signal 102, such as high frequency noise, before the signal is provided to the comparator circuit 86. This may especially be the case, if the input to the moisture sensor input circuit 84 is capacitively shunted or diode clamped.

The comparator circuit 86 may be any known type of comparator including, but not limited to, an operational amplifier comparator or a dynamic latched comparator. Some comparator circuits 88 may have built in hysteresis, which in effect can filter some of the rapid changes due to noise in the input signals to the comparators. This may include high frequency noise that may be present in the moisture sensor output signal.

Figure 4A:
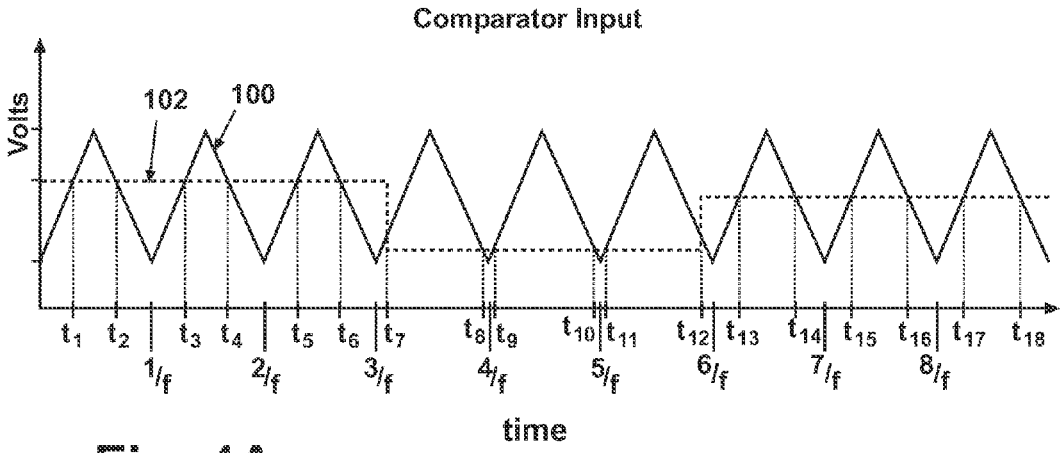
FIG. 4A is a graph of a moisture sensor signal superimposed upon an oscillation signal to demonstrate the operation of the modulator of FIG. 3.
Figure 4B:
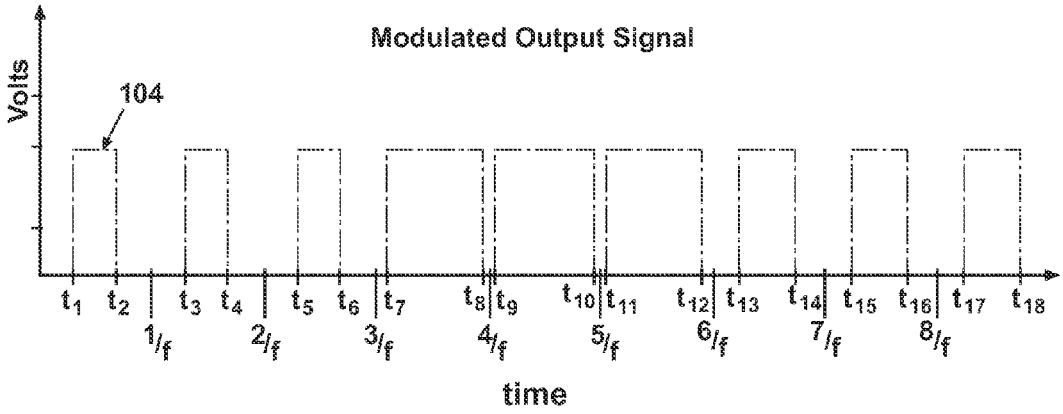
FIG. 4B is a graph of the modulated output signal as an output of the modulator of FIG. 3 corresponding to the moisture sensor signal of FIG. 4A.

For illustrative purposes, modulation of a realistic moisture sensor signal will be explained in conjunction with FIGS. 4A and 4B. FIG. 4A is a graph of a moisture sensor signal 102 superimposed upon a reference signal 100 from the oscillator circuit 94 with an oscillation period of 1/f, where f is the frequency of the reference signal. FIG. 4B is a graph of the modulated output signal 104 from the comparator corresponding to the moisture sensor signal of FIG. 4A. Between time $t_1$ and $t_2$, the moisture sensor output signal 102 is less than the reference signal 100 from the oscillator circuit 82 and therefore the modulated output signal 104 is high during that time span. Between time $t_2$ and $t_3$, the moisture sensor output signal 102 is greater than the reference signal 100 from the oscillator circuit 82 and therefore the modulated output signal 104 is low during that time span. The same holds true for the time spans between $t_4$ and $t_5$, $t_6$ and $t_7$, $t_8$ and $t_9$, $t_{10}$ and $t_{11}$, $t_{12}$ and $t_{13}$, $t_{14}$ and $t_{15}$, and $t_{16}$ and $t_{17}$. Again, between time $t_3$ and $t_4$, the moisture sensor output signal 102 is less than the reference signal 100 from the oscillator circuit 82 and therefore the modulated output signal 104 is high during that time span. The same holds true time spans between $t_5$ and $t_6$, $t_7$ and $t_8$, $t_9$ and $t_{10}$, $t_{11}$ and $t_{12}$, $t_{13}$ and $t_{14}$, $t_{15}$ and $t_{16}$, and $t_{17}$ and $t_{18}$.

A low moisture sensor output signal 102 implies a high degree of wet clothes shunting the spaced contacts 72 and therefore, implies a high degree of moisture in the laundry. When there is a high degree of moisture in the laundry, the modulated output signal 104 has a greater duty cycle than when there is greater moisture in the laundry.

The modulated output signal 104 and its time varying duty cycle may be monitored by the logic circuits 90 of the controller 80 to determine the level of moisture present in the laundry. For example, a moving average of the duty cycle of the modulated output signal may be determined by the controller 80 and used to predict the level of moisture in the laundry. The controller 80 may also predict initial or updated drying completion times based on the modulated output signal 104. The controller may further effect changes to the clothes dryer cycle of operation based upon the modulated output signal 104. For example the controller 80 may stop the cycle of operation of the clothes dryer 10 when a predetermined moisture level as indicated by the modulated output signal 104, or a rolling average or a predefined filtered value of the modulated output signal 104 is reached. In another case, the controller 80 may switch over to an alternate moisture sensing mechanism, such as an inlet and outlet temperature based moisture sensing algorithm, when a predetermined moisture level as indicated by the modulated output signal 104 is reached.

Alternatively, comparator circuit 86 can be configured such that a low modulated output signal is produced when the reference signal is greater than the moisture sensor output signal. In that case, a greater duty cycle of the modulated output signal results from less moisture in the laundry.

Figure 5:
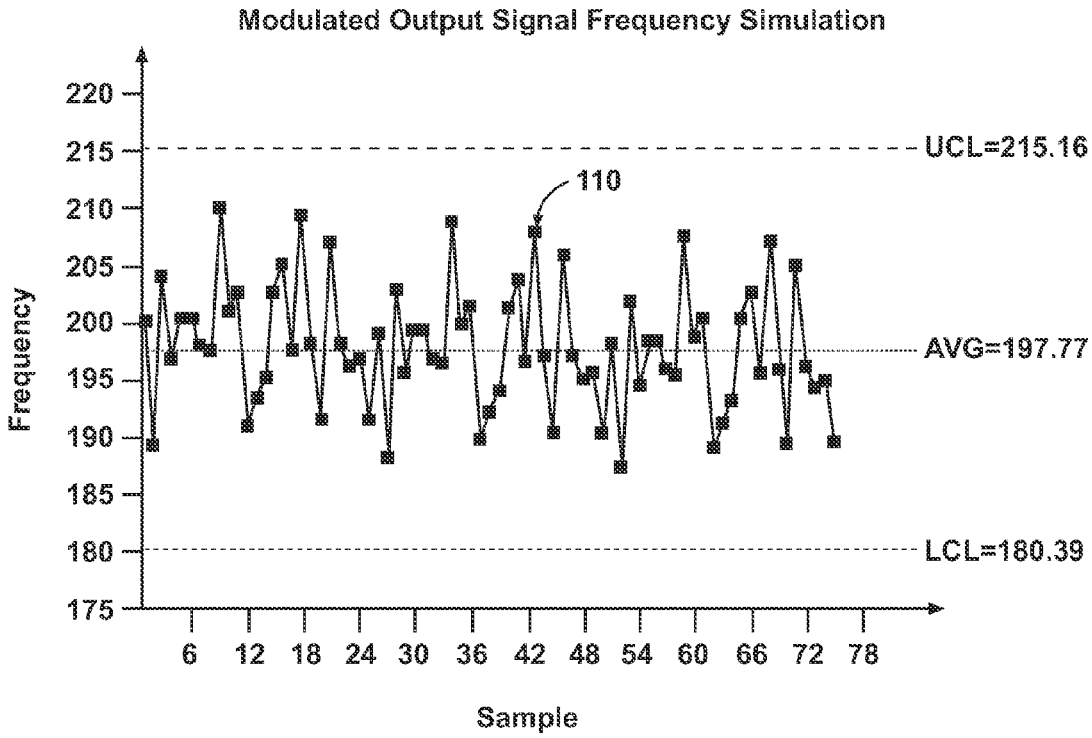
FIG. 5 is a graph of the modulated output signal frequency variation based on simulation and statistical analysis of the variable circuit component tolerances affecting the modulated output signal frequency shown with upper and lower expected control limits.

One advantage of the method of modulation described is that the moisture sensor output signal with a wide spectrum of frequency components can be represented by a modulated output signal with a relatively narrow spectral range. FIG. 5 shows a numerical circuit simulation plotting the frequency on a linear scale of several samples of a modulated output signal 110, where all of the samples lie in a tight frequency band centered at 197.77 Hz with no points lying outside of a +/−3 sigma control limits.

Figure 6:
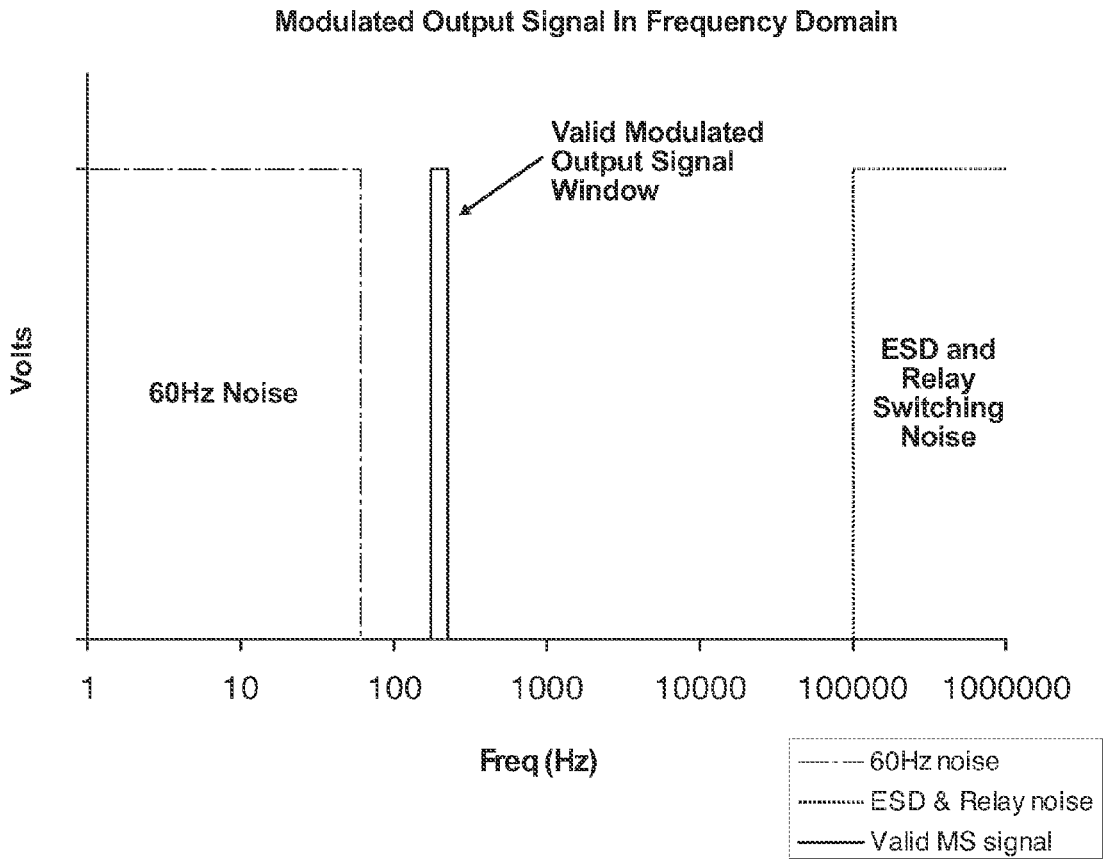
FIG. 6 is a graph of the modulated output signal along with common sources of noise plotted in the frequency domain.

FIG. 6 shows a spectral representation of the modulated output signal, as well as, common sources of noise plotted in the frequency domain with a logarithmic scale abscissa. At the lower frequencies, such as at less than 100 Hz, there may be a high prevalence of 60 Hz (or 50 Hz in Europe and other countries) power line noise. The 60 Hz power line voltage and harmonics thereof may induce a time varying electrical field of the same frequency that may induce a voltage change across the spaced contacts 72 of the moisture sensor 70, and thereby, injecting noise on to the moisture sensor output signal 102. This noise may lie in a spectral range that overlaps with portions of the spectral range of the moisture sensor output signal. At frequencies around 100 kHz and greater, there is a prevalence of switching noise, including the switching of relays, actuation of electromechanical devices, and switching of transistors. The clothes dryer has several relays and switches associated with the heating element 40, motor 54, and blower 60 and the actuation of any of these components 40, 54, and 60 may transmit an electromagnetic wave or induce a time varying electric field that may induce a voltage change across the spaced contacts 72 of the moisture sensor 70. In the same general frequency band as the switching noise, there is also electrostatic discharge (ESD) noise. The tumbling of laundry within the drying chamber 34 of the clothes dryer 10 may induce electrostatic charge on one or more pieces of laundry. Upon the buildup of sufficient charge, the charge may arc across one piece of laundry to another piece of laundry, to the drum 28, or directly to the moisture sensor spaced contacts 72. Such a discharge event may induce or inject a voltage or current across or into the spaced contacts 72 of the moisture sensor 70.

Modulated output signal 104 window is around 200 Hz in this case, but could be anywhere between approximately 200 Hz and 50 kHz and still have sufficient spectral separation from the common sources of noise. The modulated output signal window of around 200 Hz as depicted in FIGS. 5 and 6 may be close to the third harmonic of 60 Hz line noise (180 Hz) or the fourth harmonic of 50 Hz line noise (200 Hz), however, it is expected that the noise injection from these higher order harmonics are significantly attenuated.

Figure 7A:
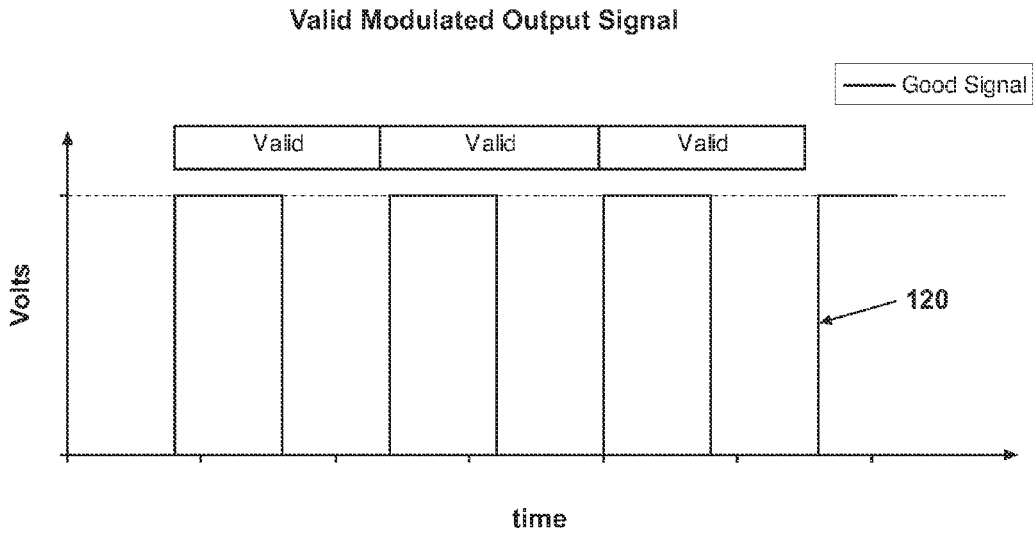
FIG. 7A is a graph of a valid modulated output signal as an output of the modulator of FIG. 3.

Now the discussion will focus on the modulated output signal and how it appears when it is valid and when it is corrupted. FIG. 7A shows an example of a valid modulated output signal 120 plotted against time. The frequency of the signal 120 is consistent throughout the time, amounting to three complete periods of the signal, shown on this plot. Each period is defined as the time from one rising edge of the modulated output signal to the next rising edge of the modulated signal. The duty cycle, or how long the modulated output signal 120 stays high depends on the moisture sensor output signal 102. The signal in all of the periods shown in FIG. 7A may lie within the modulated output signal frequency band, for example between 180.39 Hz and 215.16 Hz as shown in FIG. 5.

Figure 7B:
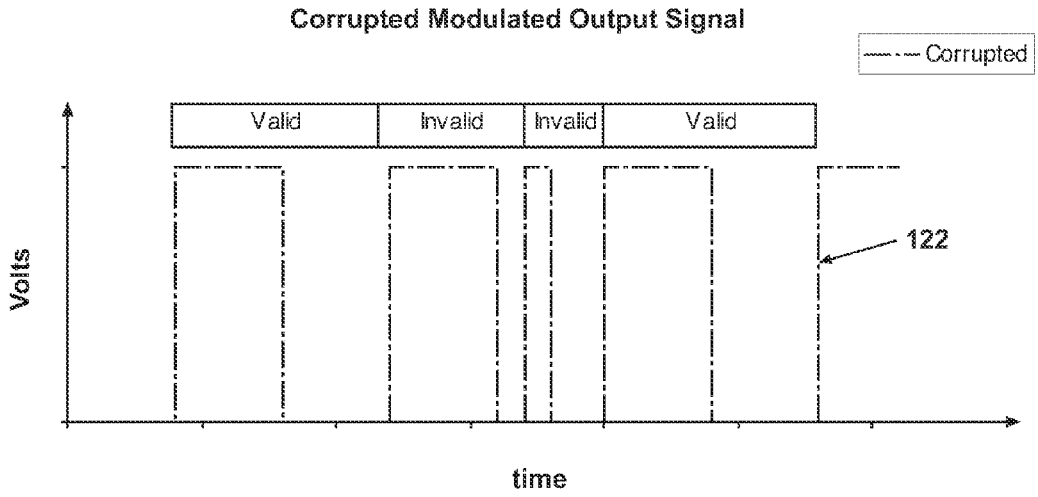
FIG. 7B is a graph of a corrupted modulated output signal as an output of the modulator of FIG. 3.

FIG. 7B on the other hand shows an example of a corrupted modulated output signal 122. In this case, over the time shown, the first period of the signal 122, as well as the fourth period, has a frequency similar to each other. The modulated output signal 122 during those two times is valid. However, the second period, defined from the second rising edge of the modulated output signal 122 to the third rising edge of the modulated output signal 122, is a shorter time than the first period of the modulated output signal 122, defined as the time from the first rising edge of the modulated output signal 122 to the second rising edge of the modulated output signal 122. During this time period the frequency of the signal may be greater than the frequency of the reference signal 100. The signal is therefore, corrupted during this time period. Likewise, the third period, defined from the third rising edge of the modulated output signal 122 to the fourth rising edge of the modulated output signal 122, is a shorter time than the first period of the modulated output signal 122. Therefore, during that third period, the modulated output signal 122 is corrupted and lies outside of modulated output signal frequency band.

The modulated output signal 122 may be corrupted by 60 Hz power line noise, switching noise, or ESD noise before or after the moisture sensor output signal 102 has been modulated to the modulated output signal 122. This may manifest itself as the corrupted portions of modulated output signal 122 of FIG. 7B. Also very short spurious sensed contacts of clothes with the dryer contacts will be filtered out as invalid as well, since the duty cycle information based modulation is not fully realized when wet laundry contact is made and broke within one cycle of the periodic signal.

The modulated output signal can also be corrupted due to aliasing errors during the modulating process. Aliasing can occur if the Nyquist criterion is not met during the modulation process. The Nyquist criterion requires that a sampling or modulation be done at a frequency of at least twice the highest frequency of the baseband signal. In other words, if the frequency of the reference signal 100 is not at least twice the highest frequency of the moisture sensor output signal 102, then there may be errors in the sampling and modulation of the moisture sensor output signal 102. This modulation error may manifest itself as the corrupted portions of modulated output signal 122 as shown in FIG. 7B, where there are frequency components in the modulated output signal 102 outside of the intended frequency band of the modulated output signal 102.

In general, having a higher frequency of the reference signal 100, and therefore, a higher frequency band of the modulated output signal 104, 120, and 122, may lead to a reduced level of aliasing error. However there may be other trade-offs related to a higher modulation frequency. New hardware may be required for accommodating a higher modulation frequency. For example, a different and potentially more expensive and more power consuming comparator circuit with reduced slew rate limitations may be required for high modulation frequencies.

When the signal lies outside of the modulated output signal frequency band, the signal may be filtered by the filter circuit 88. The filter circuit 88 to filter corrupted portions of a modulated output signal 122 may be any known filter circuit. These include low-pass filters, high-pass filters, or band-pass filters. Band-pass filters may be particularly suited in allowing the passage of valid modulated output signal 120 while rejecting portions of corrupted modulated output signal 122 that fall outside of the modulated output signal frequency. The band-pass filter circuit 88 may have a bandwidth that is wider than the modulated output signal 104, 120, and 122 frequency band. In other words, the modulated output signal 104, 120, and 122 frequency band may lie within the pass-band of the band-pass filter circuit 88. The pass-band of the band-pass filter circuit 88 may be the region between the 3 decibel (3 dB) roll-off points. The filter can be passive, active or done with digital signal processing techniques including sorting the duty cycle information as valid or invalid based on if the frequency of the signal is within the defined frequency limits.

Figure 8:
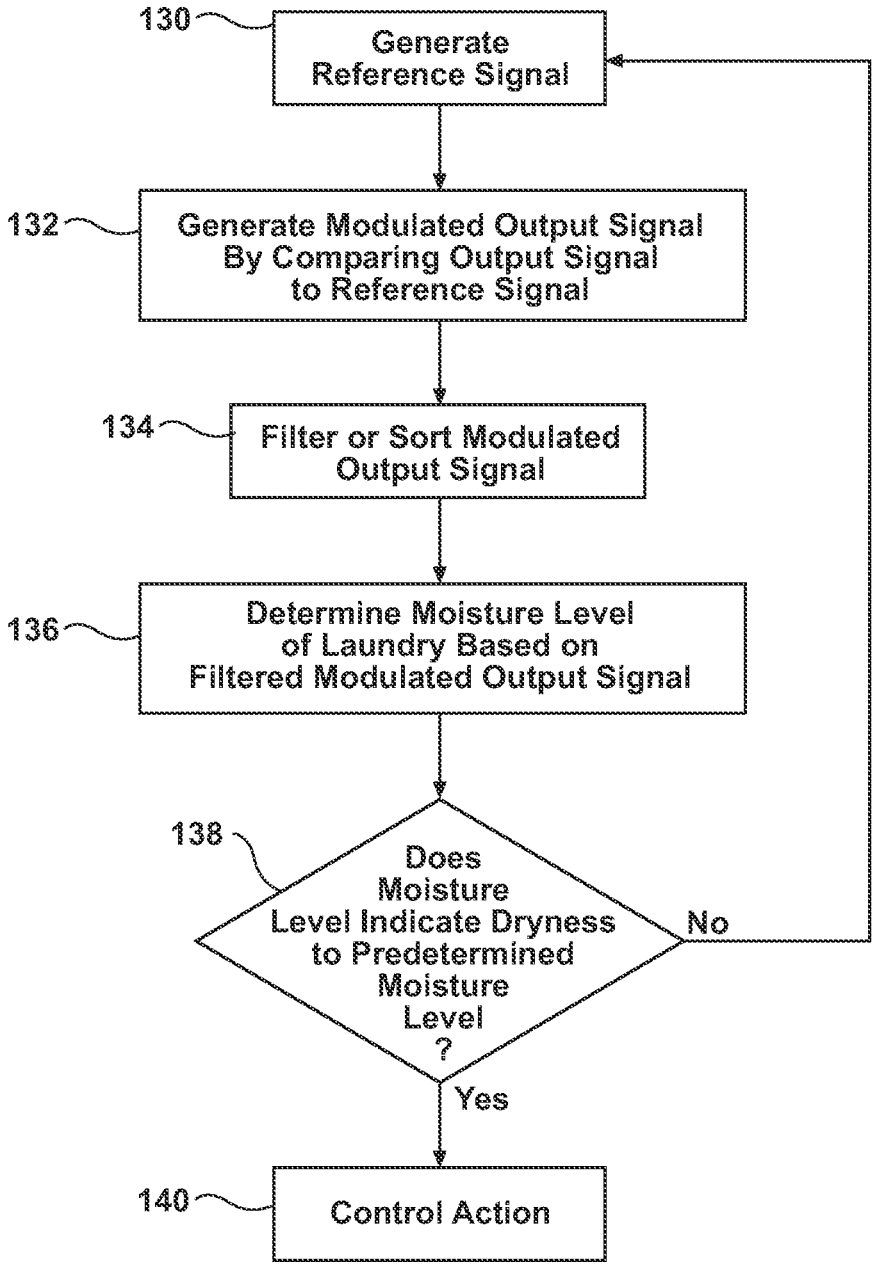
FIG. 8 is a flow chart depicting an embodiment of the present invention for moisture sensor noise immunity.

FIG. 8 is a flow chart summarizing the method of providing moisture sensor 70 noise immunity described herein. First, the reference signal is generated at 130 by the oscillator circuit 82. The modulated output signal is then generated by comparing the reference signal to the moisture sensor output signal at 132 by the comparator circuit 86. The modulated output signal is filtered or sorted at 134 by the filter circuit 88. The filtered modulated output signal is then used to determine the moisture level of the laundry at 136 by the controller 80 and the logic circuit portions 90 contained therein. At 138, it is determined if the moisture level indicates dryness of the laundry to a predetermined threshold. If it is dry to the predetermined threshold, then some control action may be taken at 160. If, however, a predetermined moisture level has not been achieved at 138, then the method repeats from 130 and continues to modulate and filter the moisture sensor 70 output signal and ascertain the moisture level from the modulated and filter signal to determine if a predetermined dryness level is met. The control action at 160 may include stopping the cycle of operation, move to the next drying phase, notify the user of reaching the predetermined moisture level, switching to other methods of dryness detection, calculating a drying time or a remaining drying time, and displaying the drying time or remaining drying time.

It can be seen that the methods disclosed herein provide noise immunity and robustness to clothes dryer moisture sensor signals. This is done primarily by modulating the moisture sensor output signal and then filtering the modulated output signal to remove noise. The process of modulation allows for the moisture sensor output signal to be encoded, such as by PWM, and shifted to a different frequency band than the original base band signal. This has two beneficial effects; first, a wide spectrum signal is encoded to a narrow frequency band which enables post modulation filtering, and second the frequency band of the modulated output signal can be chosen to not overlay the frequency spectrum of commonly known sources of noise.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of controlling operation of a clothes dryer comprising a drying chamber and a moisture sensor having a conductivity circuit with spaced contacts extending into the drying chamber and providing an output signal related to a conductivity of laundry, the method comprising:

modulating the output signal to a frequency band different than the frequency band of the output signal by generating a pulse width modulation of the output signal having a duty cycle indicative of the laundry providing electrical conductivity across the spaced contacts to form a generated modulated output signal; and filtering the modulated output signal within a predetermined frequency band to generate an output signal indicative of laundry providing electrical conductivity across the spaced contacts.

2. The method of claim 1 wherein the modulating the output signal further comprises generating a reference signal at a predetermined frequency.

3. The method of claim 2 wherein the reference signal is an oscillating signal, oscillating at the predetermined frequency.

4. The method of claim 2 wherein the modulating the output signal further comprises comparing the output signal to the reference signal.

5. The method of claim 4 wherein the modulated output signal is representative of moisture content of the laundry.

6. The method of claim 1; wherein the duty cycle is indicative of a level of moisture in the laundry.

7. The method of claim 1 wherein the filtering the modulated output signal further comprises band pass filtering where the predetermined frequency band is substantially passed and other frequency bands are substantially rejected.

8. The method of claim 7 wherein the rejected frequencies are those that are known to generate noise in the modulated output signal.

9. The method of claim 8 wherein the rejected frequencies include AC line noise, AC line coupling, circuit switching noise, electrostatic discharge noise, and harmonics of any of these noise sources.

10. The method of claim 1 wherein the predetermined frequency band is at least 179 Hz and at most 216 Hz.

11. The method of claim 1 wherein the operation of the clothes dryer is stopped when the modulated output signal indicates that a laundry moisture content is under a predetermined level.

12. A clothes dryer, comprising:

a drying chamber for holding laundry;

a moisture sensor having a conductivity circuit with spaced contacts extending into the drying chamber and providing an output signal related to the conductivity of the laundry;

a modulator circuit modulating the output signal to a frequency band different than the frequency band of the output signal by generating a pulse width modulation of the output signal having a duty cycle indicative of the laundry providing electrical conductivity across the spaced contacts to form a generated modulated output signal; and a filtering function filtering the modulated output signal within a predetermined frequency band to generate an output signal indicative of the laundry providing electrical conductivity across the spaced contacts.

13. The clothes dryer of claim 12 wherein the modulator circuit further contains an oscillator circuit for generating a reference signal and a moisture sensor input circuit for accepting the output signal of the moisture sensor.

14. The clothes dryer of claim 13 wherein the modulator circuit further contains a comparator circuit comparing the reference signal and the output signal.

15. The clothes dryer of claim 12 wherein the filtering further consists of a band pass filter function that passes the predetermined frequency band.

16. The clothes dryer of claim 12 further comprising a controller for initiating a control action based on the modulated output signal indicative of the laundry providing electrical conductivity across the spaced contacts.

* * * * *